US011278051B2

(12) United States Patent
Zhao

(10) Patent No.: US 11,278,051 B2
(45) Date of Patent: Mar. 22, 2022

(54) HEAT-NOT-BURN CIGARETTES

(71) Applicant: Xue Zhao, Kunming (CN)

(72) Inventor: Xue Zhao, Kunming (CN)

( * ) Notice: Subject to any disclaimer, the term of this patent is extended or adjusted under 35 U.S.C. 154(b) by 379 days.

(21) Appl. No.: 16/426,417

(22) Filed: May 30, 2019

(65) Prior Publication Data

US 2019/0373948 A1 Dec. 12, 2019

(30) Foreign Application Priority Data

May 31, 2018 (CN) ..... 201810544152.6
May 31, 2018 (CN) ..... 201820828153.9

(51) Int. Cl.

| | |
|---|---|
| ***A24F 47/00*** | (2020.01) |
| ***A24D 3/10*** | (2006.01) |
| ***A24D 1/00*** | (2020.01) |
| ***A24D 3/06*** | (2006.01) |
| ***A24D 1/02*** | (2006.01) |
| ***A24D 1/20*** | (2020.01) |
| ***A24D 1/22*** | (2020.01) |

(52) U.S. Cl.

CPC ..... *A24D 1/02* (2013.01); *A24D 1/002* (2013.01); *A24D 1/20* (2020.01); *A24D 1/22* (2020.01); *A24D 3/062* (2013.01); *A24D 3/10* (2013.01)

(58) Field of Classification Search

None

See application file for complete search history.

(56) References Cited

U.S. PATENT DOCUMENTS

| | | | | |
|---|---|---|---|---|
| 5,159,940 | A * | 11/1992 | Hayward | A24B 15/165 131/194 |
| 2015/0027458 | A1* | 1/2015 | Grant | A24D 3/18 131/328 |
| 2015/0296882 | A1* | 10/2015 | Mironov | A24C 5/54 131/330 |
| 2017/0318859 | A1* | 11/2017 | Batista | B65D 85/109 |

* cited by examiner

*Primary Examiner* — Dennis R Cordray

(74) *Attorney, Agent, or Firm* — Hauptman Ham, LLP

(57) ABSTRACT

The invention pertains to the technical field of novel tobacco, and in particular relates to a cigarette structure for heat-not-burn cigarettes. A heat-not-burn cigarette comprising: an envelope that is cylindrical and hollow, a cleaning isolation sleeve disposed at a front end of the envelope, and a smoking article zone and a cooling and filtration zone sequentially disposed in the envelope. With the cleaning isolation sleeve, the invention prevents the tobacco shreds from dropping out when a user inserts the heating body into the cigarette, and prevents fine part in the smoking article from falling into the heater during heating, thereby ensuring cleanness of the heater.

13 Claims, 7 Drawing Sheets

HEAT-NOT-BURN CIGARETTES

FIELD OF THE INVENTION

The invention pertains to the technical field of novel tobacco, and in particular relates to a cigarette structure for heat-not-burn cigarettes.

BACKGROUND OF THE INVENTION

The main feature of the heat-not-burn cigarettes includes that they do not burn tobacco, the heating temperature thereof is lower than 350° C., and only a small amount of second-hand smoke is generated during the heating process. Therefore, the heat-not-burn cigarettes have attracted the attention of major domestic and foreign tobacco companies and become a current research focus.

The existing smoking articles for heat-not-burn cigarettes are divided into a tobacco shred type and a thin sheet type. The filler of the tobacco shred type is a cut tobacco leaf or a cut tobacco stem, which is formed by a cigarette machine through a common cigarette technical process. The filler of the thin sheet type is a tobacco thin sheet which is formed, using a multiple-combined filter assembler, from thin tobacco shreds produced by a combined technical process. Due to their own characteristics of the processes for tobacco shred and thin sheet, the current fillers in the cigarette smoking zones are a filament.

The heaters of existing heat-not-burn cigarettes are divided into two types: plug-in heating and non-plug-in wrap heating. The plug-in heating is performed by a needle or a sheet heating body which is inserted into a smoking article in a cigarette. Before a consumer draws the cigarette, the heating body is first inserted into the cigarette, and tobacco shreds in the cigarette are easily dropped out and enter the heater. After the consumer draws the cigarette, the coked smoking article in the cigarette adheres to the needle or sheet heating body, thereby remaining in a heating cavity of the heater and resulting in odor during the second time of smoking and release of more harmful ingredients. The retention of the smoking article also leads to poor heat transfer during the second heating, and meanwhile makes cleaning extremely inconvenient, which degrades user experience and product safety. Further, the long-term accumulation of residues in the heater makes the heater susceptible to scaling and damage, which reduces the service life of the heater.

In addition, a heat-not-burn cigarette of tobacco shred or cut tobacco stem can be merely applied to a needle heater or a wrap heater, because when a blade-type heating body is inserted into the cigarette, due to a great resistance, the smoking article at the front end of the cigarette is easily pushed into the hollow zone at the rear of the smoking article, thereby causing blockage of the hollow zone, so that the draw resistance of the cigarette increases, and the consumer will not be able to inhale the heated aerosol.

SUMMARY OF THE INVENTION

It is an object of the invention to solve the deficiencies of the prior art and to provide a cigarette structure for heat-not-burn cigarettes dedicated to a plug-in heating device.

The invention is achieved by the following technical solutions:

A heat-not-burn cigarette comprising: an envelope that is cylindrical and hollow, a cleaning isolation sleeve disposed at a front end of the envelope, and a smoking article zone and a cooling and filtration zone sequentially disposed in the envelope, wherein the cleaning isolation sleeve is provided with a plurality of air inlet holes in a region thereof covering a cross section of the envelope, and has a thickness of 3 μm to 3 mm; the smoking article zone is, at one end thereof, intimately connected to the cleaning isolation sleeve and, at the other end thereof, connected to the cooling and filtration zone; the cooling and filtration zone is formed by one of a limit segment, a temperature control segment, a hollow segment and a filtration and adsorption segment, or a combination thereof; and the smoking article segment and the cooling and filtration segment have a diameter equivalent to an inner diameter of the envelope. The portion of the envelope surrounding the smoking article zone and the portion of the envelope corresponding to the hollow segment are provided with a plurality of air supplement holes.

Preferably, the cleaning isolation sleeve is made of a flexible sheet material, the cleaning isolation sleeve surrounds and covers the front end of the envelope, and a portion out of the part covering the cross section of the envelope is folded and pressed to intimately bond to and integrally form with an outer wall of the envelope, or adhered on the wall of the front section of the envelope. When the cleaning isolation sleeve with such structure is used, the envelope is further wrapped at the outer side thereof with an aesthetic paper in an axial direction of the envelope, the aesthetic paper having a length equivalent to that of the envelope. The length of the aesthetic paper may be smaller than that of the envelope.

Preferably, the cleaning isolation sleeve is in a shape of a disk and has a diameter equivalent to an outer diameter of the envelope, and the cleaning isolation sleeve covers ends of the envelope and the smoking article zone by gluing.

Preferably, the cleaning isolation sleeve has a circular bottle cap structure that is provided around the front end of the envelope, and a fastening edge portion of the cleaning isolation sleeve is snapped around the outer wall of the envelope at the front end thereof, or inserted into the inner wall of the envelope at the front end thereof.

Preferably, the materials for both the envelope and the cleaning isolation sleeve are one of aluminum foil, aluminum foil/paper composite, plastic, silica gel, gel, paper material, metal, wood and polylactic acids. Plant powder can also be selected as the materials for both the envelope and the cleaning isolation sleeve.

Preferably, the smoking article zone includes one or more of elongated strip-shaped smoking articles which are preliminarily formed in a cylindrical shape by paper rolls and arranged in the same order along the axial direction of the envelope, curved filament smoking articles which are preliminarily formed in a cylindrical shape by paper rolls and arranged in random order, and irregular granule smoking articles.

The elongated strip-shaped smoking articles which are preliminarily formed in a cylindrical shape by paper rolls and arranged in the same order along the axial direction of the envelope include: a. filament smoking articles that is arranged in the same order along the axial direction of the cigarette and made from tobacco thin sheet; b. filament smoking articles that is arranged in the same order along the axial direction of the cigarette and made from jute pulp fiber thin sheet; and c. filament smoking articles that is arranged in the same order along the axial direction of the cigarette and made from wood pulp fiber thin sheet. The curved filament smoking articles which are preliminarily formed in a cylindrical shape by paper rolls and arranged in random order include: (1) curved cut tobacco stem smoking articles arranged in random order; (2) tobacco shreds arranged in random order, (3) cut stems arranged in random order, and (4) cut tobacco stems. The irregular granule smoking articles include: smoking articles of expanded tobacco stem particles by microwave and expanded plant particles by microwave. The expanded plant particles by microwave include particles made from cannabis flower and cannabis leaves through microwave expansion method.

The limit segment is a cylindrical body produced and molded by one or a combination of ceramic, wood, silica gel, plastic, polylactic acids, cellulose acetate fiber, plant powder, metal or other moldable high temperature resistant materials, and the limit segment is provide with at least one through-type aerosol passage opening. The aerosol passage opening is in one of a circular shape, an elliptical shape, a fusiform shape, a fan shape, a triangular shape, and shapes with 4-24 sides, and has a cross-sectional area that is 10-95% of the cross-sectional area of the limit segment.

The temperature control segment is a cylindrical body formed by wrapping multiple polylactic acid fibers or fibers having an endothermic effect with a paper material along the axial direction of the envelope. At least one hollow tube is further provided through the cylindrical body. The hollow tube has a plurality of holes formed in the tube wall, and has a total cross-sectional area that is 10-95% of a cross-sectional area of a controlled filtration unit. The filtration and adsorption segment is a cylindrical body formed by wrapping at least one of multiple polylactic acid fibers, cellulose acetate fibers, and wood pulp fibers with a paper material.

Preferably, the limit segment is a spiral limiting spring and is not adjacent to the hollow segment, and the limiting spring has a diameter smaller than or equal to the inner diameter of the envelope.

Preferably, the temperature control segment is a cylindrical filter rod of cellulose acetate fiber or a paper filter rod of wood pulp fiber, and polylactic acid powder or particles with a particle size ranging from 20 to 1200 mesh are homogeneously added to the cellulose acetate fiber or wood pulp fiber of the filter rod.

Preferably, the temperature control segment is a spiral temperature control spring wrapped with polylactic acid fiber, and the temperature control spring has a diameter smaller than or equal to the inner diameter of the envelope.

Compared with the prior art, the invention has the following beneficial effects:

1. With the cleaning isolation sleeve, the invention prevents the tobacco shreds from dropping out when a user inserts the heating body into the cigarette, and prevents fine part in the smoking article from falling into the heater during heating, thereby ensuring cleanness of the heater.

2. The cleaning isolation sleeve of the invention has a minimum thickness of 3 μm and is made of a flexible material. Therefore, the consumer can readily pierce the heating body into the cleaning isolation sleeve during use, and smoothly insert it into the smoking article, which is convenient to use.

3. Since the cleaning isolation sleeve is provided, when the consumer completes smoking, the cleaning isolation sleeve is capable of isolating the coked smoking articles adhered to the heating body, and preventing the coke in the cigarette from remaining in the heating cylinder, thereby ensuring the cleanness of the heater after each use.

4. With the limit segment provided, the invention prevents the smoking articles in the envelope (especially winding and curved filament smoking articles) from being pushed by the heating body (especially the blade type heating body) into the rear of the cigarette when the heating body is inserted into the cigarette, thus avoids the contact between the heating body and the smoking article being insufficient to affect heating effect. Further, the problem that the smoking article is squeezed and deformed to block the aerosol passage can be effectively alleviated. Also, a plurality of openings are provided in the limit segment, which can effectively transport the aerosol while delimiting the position of the smoking article, and is thus extremely reasonable design.

5. The temperature control segment having a hollow tube is provided in the invention. Even though a part of the aerosol passage blocked by deformation of the polylactic acid fibers resulting from heat absorption, the hollow tube does not deform, and can function to conveying normally aerosol. Therefore, the temperature of the aerosol can be effectively controlled, and the problem that thermal deformation of the polylactic acid fibers blocks the aerosol passage can be solved.

6. The invention effectively reduces the temperature of the aerosol in the central portion of the cigarette by providing openings in the hollow tube wall in the temperature control segment. When heat-bearing aerosol generated by heating is transmitted to the rear of the cigarette (the sucking end) through the limit segment, heat of aerosol in the portion of the cigarette near the side wall of the envelope will be absorbed by heat absorbing fibers in the temperature control segment at the corresponding position. Meanwhile, the fiber gradually deforms to block part of the aerosol passage, and when the hot aerosol in the center portion of the cigarette that has not contacted the heat absorbing fibers passes through the hollow tube, the heat energy of the aerosol will be continuously absorbed by the heat absorbing fibers at corresponding position of the openings in the wall, so that the cooled aerosol can be continuously transmitted through the tube toward the sucking end of the cigarette.

7. The invention reduces the aerosol temperature by providing a hollow segment, mainly in combination with the temperature control segment. Meanwhile, as a unit that can be flexibly set in the rear of the cigarette, the hollow segment has not only a function of reducing temperature by cooling, but also functions of reducing draw resistance, diverting the aerosol and providing space for the limit segment or the temperature control segment.

8. When the limit segment adopts a limiting spring made of metal material, relatively more heat energy of cigarette gas can be absorbed by adjusting the density of the spiral ring of the limiting spring, and the limiting spring also has a limit function. Since the limiting spring has elasticity, it can absorb the pressure toward the rear of the cigarette generated when the heating body is inserted into the smoking articles, and does thus not cause the smoking articles to be squeezed together and deformed to cause poor contact with the heating body or partially block the cigarette gas passage. When the heating body is inserted until its position, the resilience force of the limiting spring causes the smoking articles (especially the shredded tobacco) displaced to the rear to be pushed back to the original position, thereby maintaining good contact with the heating body.

9. When the temperature control segment adopts a metal spiral spring wrapped with polylactic acid fibers or other heat-absorbing fibers, the inside of the spring is a hollow passage, which can effectively transport the aerosol. At the same time, when the aerosol passes through the cooling section of the spiral spring, heat of the aerosol is absorbed by both the polylactic acid fibers and the metal material. The diameter and length of the spiral spring and the density of the polylactic acid fiber wrapped thereon, as needed, to absorb corresponding heat of the aerosol, and therefore an effective temperature control means is provided.

10. The temperature control segment adopts the cellulose acetate filter rod with uniform addition of polylactic acid powder or particles. When the hot aerosol passes through this segment, the heat in the aerosol is preferentially absorbed by the polylactic acid powder in the cellulose acetate fibers. When absorbing heat energy, the polylactic acid powder undergoes phase transition and the powder gradually melts and deforms, but the cellulose acetate fiber does not deform and still maintains good aerosol passing ability, so that the cigarette gas temperature can be lowered while ensuring the normal flow of the cigarette gas without blocking delivery passage of the cigarette gas.

Figure 1:
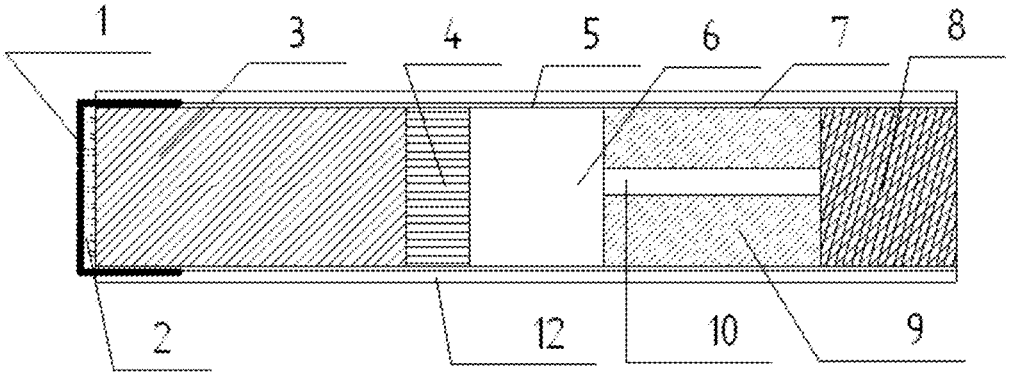
FIGS. 1 and 2 are schematic structural views of the invention.
Figure 2:
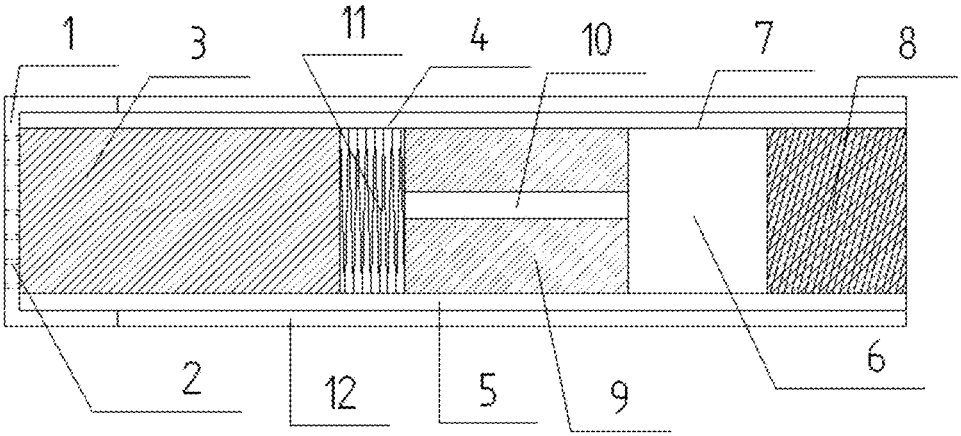
Figure 3:
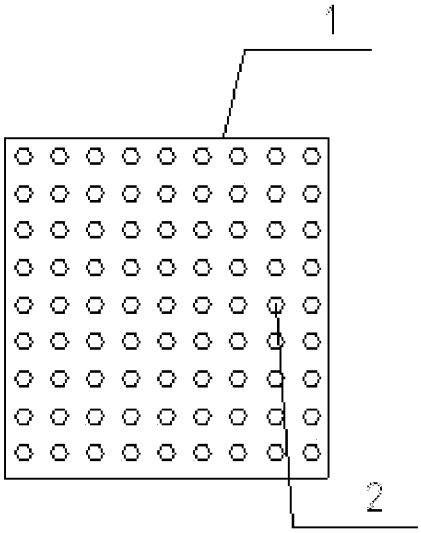
FIGS. 3 to 6 are schematic structural views of the cleaning isolation sleeve of the invention.
Figure 4:
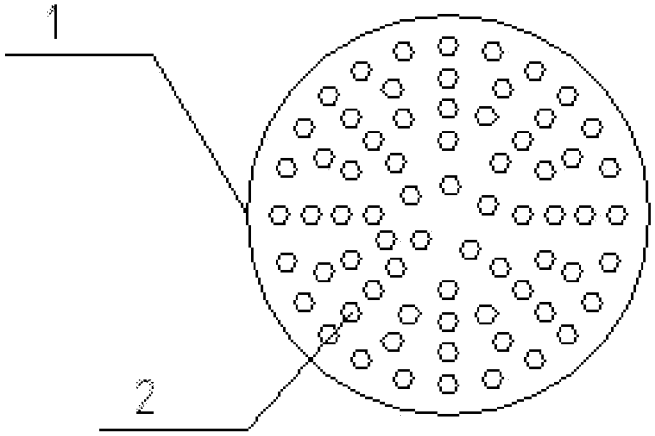
Figure 5:
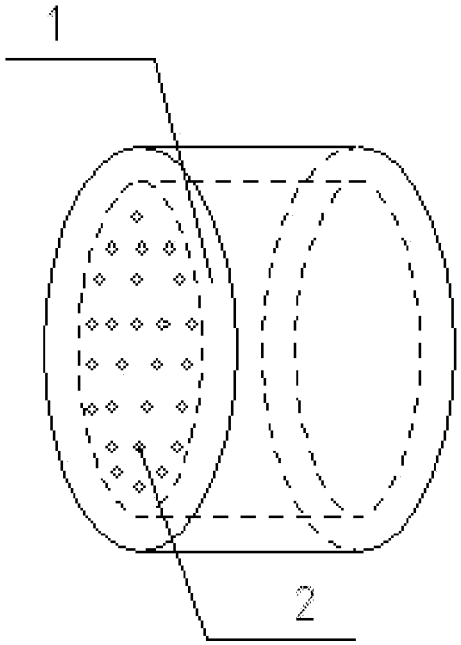
Figure 6:
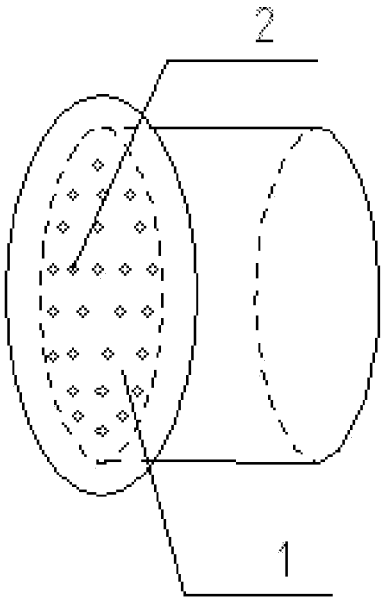
Figure 7:
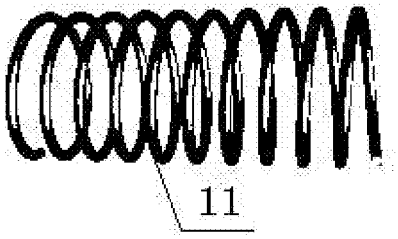
FIG. 7 is a schematic structural view of the limiting spring of the invention.
Figure 8:
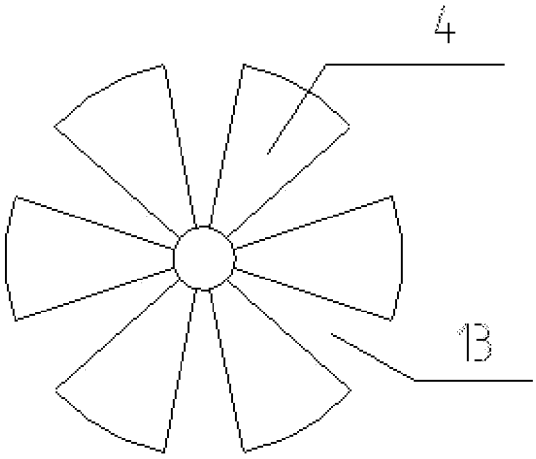
FIGS. 8 and 9 are schematic cross-sectional views of the limit segment of the invention.
Figure 9:
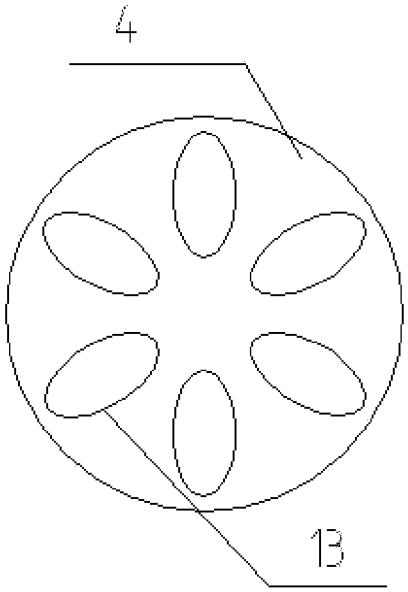
Figure 10:
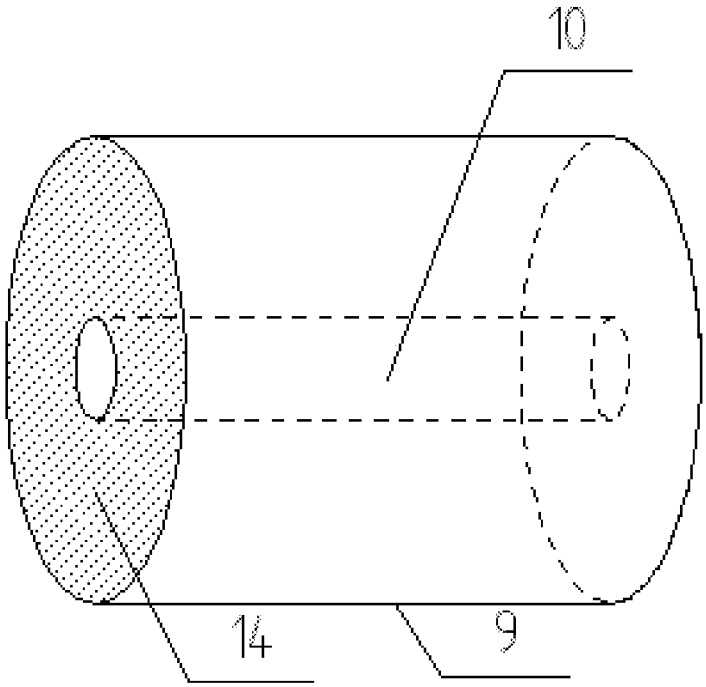
FIG. 10 is a schematic structural view of the temperature control segment of the invention.
Figure 11:
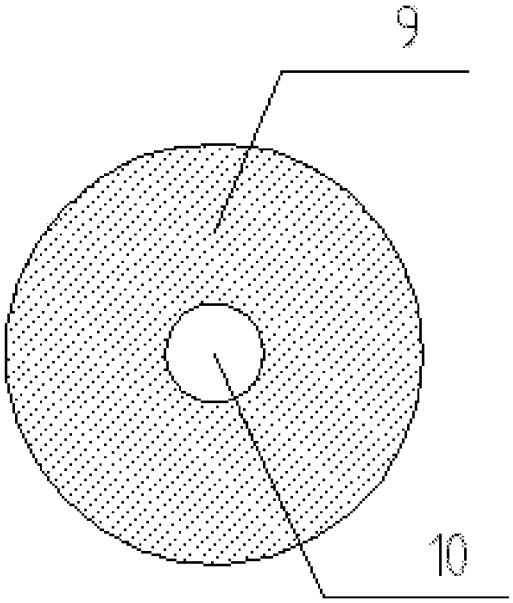
FIGS. 11 to 13 are schematic cross-sectional views of the temperature control segment of the invention.
Figure 12:
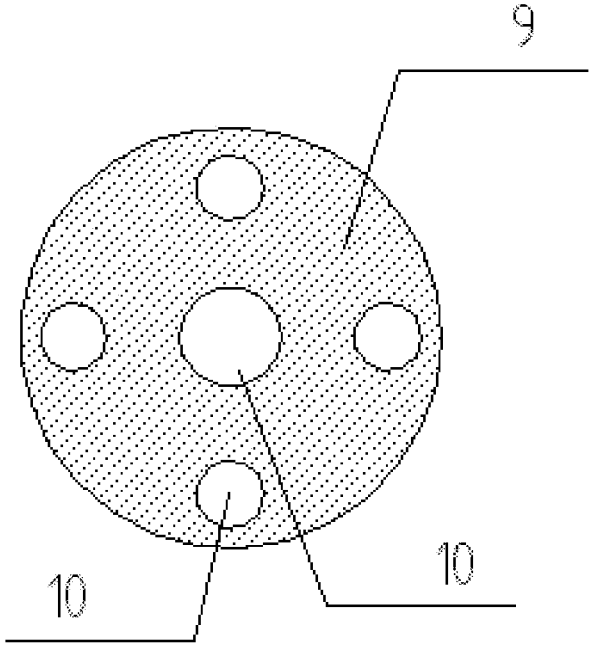
Figure 13:
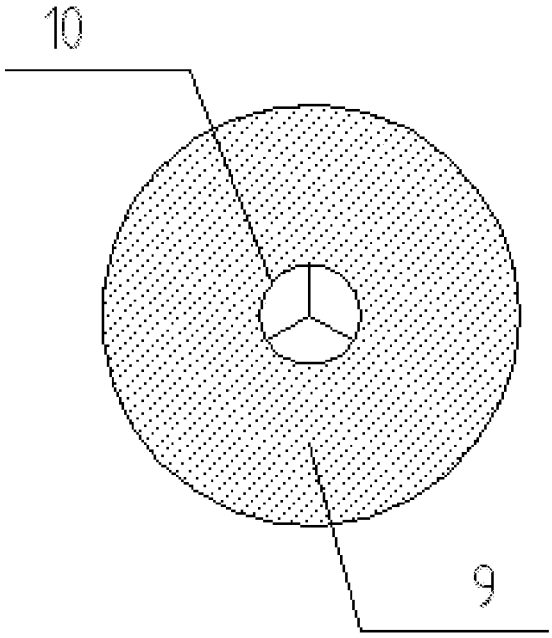
Figure 14:
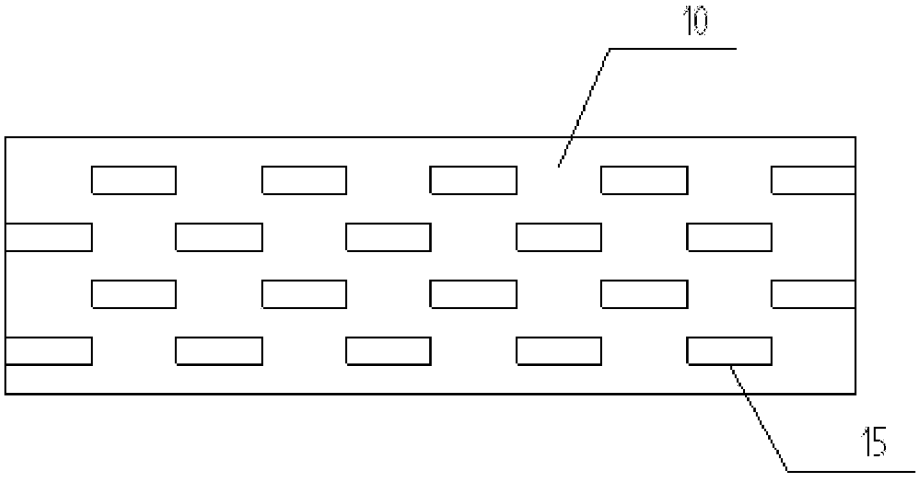
FIGS. 14 and 15 are schematic structural views of the hollow tube of the invention.
Figure 15:
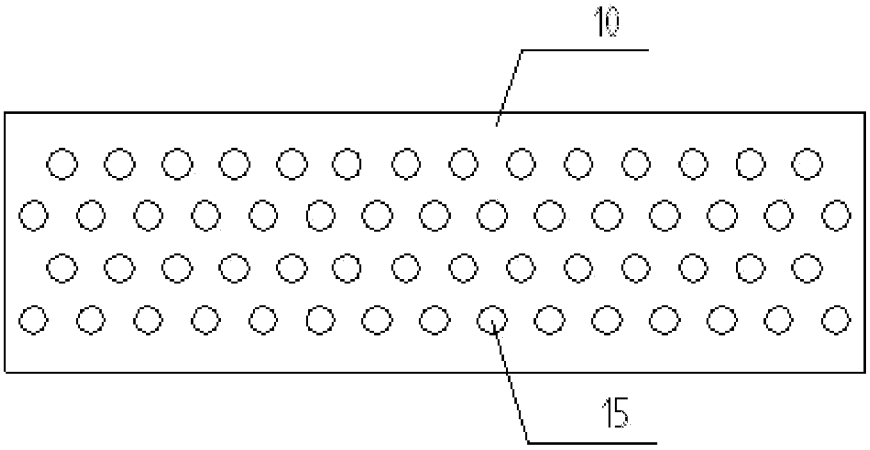

In the figure: 1—cleaning isolation sleeve, 2—inlet hole, 3—smoking article zone, 4—limit segment, 5—envelope, 6—hollow segment, 7—cooling and filtration zone, 8—filtration and adsorption segment, 9—temperature control segment, 10—hollow tube, 11—limiting spring, 12—aesthetic paper, 13—aerosol passage port, 14—polylactic acid fiber, and 15—hole.

DETAILED DESCRIPTION OF THE PREFERRED EMBODIMENTS

The invention will be further described with reference to the drawings and examples, but the scope of the invention is not limited by the examples.

EXAMPLE 1

A heat-not-burn cigarette is composed of a hollow envelope having a length of 45 mm and a diameter of 7.1 mm made of a paper with a thickness of 0.15 mm and a high stiffness, a cleaning isolation sleeve surrounding a front end of the envelope, and a smoking article zone and a cooling and filtration zone sequentially disposed in the envelope. The cleaning isolation sleeve is a pre-die-cut circular aluminum foil having a thickness of 3 μm and a diameter of 12 mm, and 20 air inlet holes having a diameter of 1 mm are provided in a circular region of a diameter of 7 mm from the center of the aluminum foil. The smoking article zone is filled with tobacco sheet filament smoking articles arranged in the same order along an axial direction of the cigarette, and has a length of 13 mm. The cooling and filtration zone is 32 mm in length and composed of two portions, of which the portion close to the smoking article is a limit segment with a length of 3 mm, and the portion connected to the limit segment and approaching the lip of the consumer is a filtration and adsorption segment with a length of 29 mm.

The limit segment is a cylinder prepared by injection molding of ABS plastic, and six aerosol passage opening having a circular cross section are formed therethrough, the total cross-sectional area of the openings being 80% of the total cross-sectional area of the limit segment. The filtration and adsorption segment includes filaments formed by drawing a PLA (polylactic acid) material; the filaments are wrapped into a cylindrical shape with a diameter equivalent to the inner diameter of the cigarette envelope by a conventional cigarette paper having a high gas permeability, and then cut in appropriate lengths and fed into the envelope.

The material of the limit segment can be replaced by metal.

Two rows of annular air supplement holes are also provided in the portion of the envelope surrounding the smoking article zone, in which the first row of holes is in a distance of 3 mm from a front port of the cigarette, and the second row of holes is in a distance of 3 mm from the first row of holes, each row having 12 holes and each of the holes having a diameter of 0.5 mm. This structure is used to supplement the natural air from outside, to ensure sufficient oxygen supply and improve heating efficiency.

When processing the cigarette, the paper envelope of a length is pre-cut into a length of 45 mm, and a region of the outer wall of the envelope from one end (the front end of the cigarette) to 5 mm from the envelope end face is pressed into 15 μm in thickness, so that the thickness of the aluminum foil material wrapped around and covering the front section of the envelope is substantially the same as the height of the other parts of the envelope which are not thinned, without forming convex outer wall of the front section of the envelope after wrapping. The filtration and adsorption segment made of PLA (polylactic acid) fiber is first filled into a pre-prepared paper envelope, with the cross section being parallel with the bottom of the envelope (near sucking end of the consumer), successively into the limit segment and the filament sheet smoking article zone, with one end of the smoking article zone being at the same level as the front end surface of the cigarette, and finally the aluminum foil cleaning isolation sleeve is wrapped at the end of the cigarette. The cleaning isolation sleeve covers the front end surface of the cigarette, and the center opening coincides with the circular cross sectional port of the front section of the cigarette, and the excess part of the circular sheet out of the cross section of the cigarette is folded by the die and wrapped around the outer wall of the front section of the cigarette, and then tightened by the die to make it fit closely with the outer wall. Finally, a piece of conventional cigarette tipping paper (aesthetic paper) with a thickness of 0.1 mm is wrapped along the axial direction of the envelope and bonded by glue, with a length being equivalent to the length of the envelope.

When consumer uses the structural cigarette, the length of a heating body of the heater should not exceed 13 mm. The cigarette is inserted along the heater cigarette guide into a needle heater, and the heating needle is inserted through the cleaning isolation sleeve smoothly into the smoking article zone to heat and produce aerosol for the consumer. After consummation, when the cigarette is pulled out, the smoking article is not dropped in the heating barrel of the heater due to the blockage by the cleaning isolation sleeve. Therefore, the consumer does not need to clean the heating chamber or the heating needle frequently, which is convenient and practical.

Such a structural cigarette is suitable for a heater that is heated by a needle or sheet heating body.

EXAMPLE 2

A heat-not-burn cigarette is composed of a hollow envelope having a length of 48 mm and a diameter of 7.3 mm made of a PP material with a thickness of 0.2 mm and a high toughness, a cleaning isolation sleeve surrounding a front end of the envelope, and a smoking article zone and a cooling and filtration zone sequentially disposed in the envelope. The cleaning isolation sleeve is a pre-die-cut square aluminum foil/paper composite having a thickness of 0.2 mm and a height of 15 mm, and 30 air inlet holes having a diameter of 0.5 mm are provided in a circular region of a diameter of 7.2 mm from the center of the aluminum foil. The smoking article zone is filled with curved cut tobacco stem smoking articles which are preliminarily formed in a cylindrical shape by paper rolls and arranged in random order, and has a length of 15 mm. The cooling and filtration zone is 33 mm in length and composed of three portions, of which the portion close to the smoking article is a limit segment with a length of 5 mm, the portion connected to the limit segment is a hollow segment with a length of 20 mm, and the portion connected to the hollow segment and approaching the lip of the consumer is a filtration and adsorption segment with a length of 8 mm.

The limit segment is a cylinder prepared by injection molding of polylactic acid material, and four aerosol passage opening having a square cross section are formed therethrough, the total cross-sectional area of the openings being 60% of the total cross-sectional area of the limit segment. The filtration and adsorption segment includes ultra-fine filaments formed by ejecting cellulose acetate fiber; the ultra-fine filaments are wrapped into a cylindrical shape with a diameter equivalent to the inner diameter of the cigarette envelope by a conventional cigarette rod-forming paper, and then cut in appropriate lengths and fed into the envelope.

The material of the limit segment can be replaced by wood material or plant powder.

One row of annular air supplement holes are provided in the portion of the envelope surrounding the smoking article zone. The row of holes are in a distance of 2 mm from an isolation member, the row having 20 holes and each of the holes having a diameter of 0.3 mm. Another row of annular air supplement holes are provided in the portion of the envelope corresponding to the hollow segment. The another row of holes are in a distance of 5 mm from the end line of the smoking article, the row having 20 holes and each of the holes having a diameter of 0.3 mm. This structure is used to supplement the natural air from outside, reduce draw resistance and temperature of cigarette gas and improve heating efficiency.

When processing the cigarette, PP plastics are molded by injection molding into a hollow cylinder with a length of 48 mm, and a region of the outer wall of the envelope from one end (the front end of the cigarette) to 10 mm from the envelope end face is pressed by die into 0.1 mm in thickness, so that the thickness of the aluminum foil material wrapped around and covering the front section of the envelope is substantially the same as the height of the other parts of the envelope which are not thinned, without forming convex outer wall of the front section of the envelope after wrapping. The filtration and adsorption segment made of cellulose acetate fiber is first filled into a pre-prepared envelope, with the cross section being parallel with the bottom of the envelope (near sucking end of the consumer) and a space for the hollow segment remaining, successively filled into the limit segment and the cut stem smoking article zone, with one end of the smoking article zone being at the same level as the front end surface of the cigarette, and finally the aluminum foil cleaning isolation sleeve is wrapped at the end of the cigarette. The cleaning isolation sleeve covers the front end surface of the cigarette, and the center opening coincides with the circular cross sectional port of the front section of the cigarette, and the excess part of the circular sheet out of the cross section of the cigarette is folded by the die and wrapped around the outer wall of the front section of the cigarette that is pre-coated with glue, and then tightened by the die to make it fit closely with the outer wall. Finally, a piece of conventional cigarette tipping paper (aesthetic paper) with a thickness of 0.1 mm is wrapped along the axial direction of the envelope and bonded by glue, with a length being equivalent to the length of the envelope.

When consumer uses the structural cigarette, the length of a heating body of the heater should not exceed 15 mm. The cigarette is inserted along the heater cigarette guide into a needle heater, and the heating needle is inserted through the cleaning isolation sleeve smoothly into the smoking article zone to heat and produce aerosol for the consumer. After consummation, when the cigarette is pulled out, the smoking article is not dropped in the heating barrel of the heater due to the blockage by the cleaning isolation sleeve. Therefore, the consumer does not need to clean the heating chamber or the heating needle frequently, which is convenient and practical.

Such a structural cigarette is suitable for a heater that is heated by a needle or sheet heating body.

EXAMPLE 3

A heat-not-burn cigarette is composed of a hollow envelope having a length of 40 mm and a diameter of 7 mm made of aluminium alloy material with a thickness of 0.05 mm, a cleaning isolation sleeve affixed around a front end of the envelope, and a smoking article zone and a cooling and filtration zone sequentially disposed in the envelope. The cleaning isolation sleeve is a pre-die-cut circular sheet made of PE plastic and having a thickness of 0.1 mm and a diameter of 7 mm, and 38 air inlet holes having a diameter of 0.3 mm are provided in a circular region of a diameter of 6 mm from the center of the circular sheet. The smoking article zone is filled with tobacco stem particle smoking articles expanded by microwave, and has a length of 12 mm. The cooling and filtration zone is 28 mm in length and composed of two portions, of which the portion close to the smoking article is a limit segment with a length of 8 mm, and the portion connected to the limit segment and approaching the lip of the consumer is a hollow segment with a length of 20 mm.

The limit segment is a cylinder prepared by injection molding of silica gel material, and six aerosol passage opening having an oval cross section are formed therethrough, the total cross-sectional area of the openings being 20% of the total cross-sectional area of the limit segment.

One row of annular air supplement holes are provided in the middle portion of the envelope and the portion of the envelope corresponding to the hollow segment. The distance for the holes and the diameter of the holes are the same as those in Example 2.

When processing the cigarette, with the space for the hollow segment remaining, the limit segment and the smoking article zone of tobacco stem particle expanded by microwave are charged by positioner. A circular PE cleaning isolution sheet that is pre-prepared is affixed by heat bonding to the frond end of the cigarette. Finally, a piece of cigarette tipping paper having a product trademark printed thereon and a length of 20 mm is wrapped and bonded around the outer wall of the envelope, with one end of the aesthetic paper being aligned with the rear end of the envelope.

When consumer uses the cigarette, the length of a heating body of the heater should not exceed 12 mm. Since a plurality of openings are formed in the cleaning isolation sleeve of PE material, the toughness of the material plane is reduced, which facilitate puncture by the heating body. Meanwhile, PE is a high temperature resistant material and is not likely to generate unpleasant odor.

EXAMPLE 4

A heat-not-burn cigarette is composed of a hollow envelope having a length of 50 mm and a diameter of 7.5 mm made of wood material with a thickness of 1.5 mm, a cleaning isolation sleeve disposed around a front end of the envelope, and a smoking article zone and a cooling and filtration zone sequentially disposed in the envelope. The cleaning isolation sleeve is a cover-type silica gel cap that is pre-prepared into a bottle cap structure. The cap has a top thickness of 2 mm, a wall thickness at a lower edge of 0.2 mm, an inner diameter of 7.3 mm and a length of the lower edge of 10 mm. In a circular region with a diameter of 7 mm from the center of the cap, 40 air inlet holes with a diameter of 0.5 mm are provided. The smoking article zone is filled with tobacco sheet filament smoking articles arranged in the same order along the axial direction of the envelope, and has a length of 15 mm. The cooling and filtration zone is 35 mm in length and composed of four portions, of which the portion close to the smoking article is a limit segment with a length of 3 mm, a portion connected to the limit segment is a temperature control segment with a length of 15 mm, a portion connected to the temperature control segment is a hollow segment with a length of 10 mm, and a portion connected to the hollow segment and approaching the lip of the consumer is a filtration and adsorption segment with a length of 7 mm.

The limit segment is a cylinder formed by rolling a piece of paper, and one aerosol passage opening having a triangular cross section is formed therethrough, the cross-sectional area of the openings being 95% of the total cross-sectional area of the limit segment.

The temperature control segment is a cylinder formed by wrapping multiple polylactic acid fibers through paper, and one hollow tube with a diameter of 3 mm is passed through the center of the cylinder.

The filtration and adsorption segment is a filter rod of cellulose acetate fiber.

When processing the cigarette, wood material is preliminarily prepared into a hollow envelope of 50 mm in length, the filtration and adsorption segment made of cellulose acetate fiber is charged into the prepared envelope, with the cross section thereof being parallel with the bottom (sucking end near the consumer) of the envelope. With the space for the hollow segment remaining, the temperature control segment, the limit segment and the smoking article zone of tobacco thin sheet are successively charged, with one end of the smoking article zone being at the same level as the front end surface of the cigarette. The pre-prepared cleaning isolation sleeve is finally covered on the front end of the cigarette. Finally, a piece of conventional cigarette tipping paper (aesthetic paper) having a thickness of 0.1 mm and a length of 40 mm is wrapped and bonded by glue around the envelope along the axial direction of the envelope, with one end of the aesthetic paper being aligned with the rear end (sucking end near the consumer) of the envelope and the other end abutting with the lower edge of the cap.

The silica gel cap is made of a flexible material that is easy to be molded, and has stretch characteristics, which can not only facilitate the puncture of the heating body, but also can be industrially produced. Also, the silica gel material has high temperature resistance and does not generate unpleasant odor at high temperatures.

EXAMPLE 5

A heat-not-burn cigarette is composed of a hollow envelope having a length of 45 mm and a diameter of 7.3 mm made of silica gel with a thickness of 0.3 mm, a cleaning isolation sleeve disposed around a front end of the envelope, and a smoking article zone and a cooling and filtration zone sequentially disposed in the envelope. The cleaning isolation sleeve is an embedded polylactic acid cap that is pre-prepared into a bottle cap structure. The cap has a thickness of 0.2 mm, an inner diameter of 6.5 mm and a length of the lower edge of 5 mm. In a circular region with a diameter of 6 mm from the center of the cap, 50 air inlet holes with a diameter of 0.2 mm are provided. The smoking article zone is filled with filament smoking articles arranged in the same order along the axial direction of the cigarette and made from jute pulp fiber thin sheet, and has a length of 13 mm. The cooling and filtration zone is 32 mm in length and composed of 3 portions, of which the portion close to the smoking article is a temperature control segment with a length of 15 mm, a portion connected to the temperature control segment is a hollow segment with a length of 10 mm, and a portion connected to the hollow segment and approaching the lip of the consumer is a filtration and adsorption segment with a length of 7 mm.

The temperature control segment is a cylinder formed by wrapping multiple polylactic acid fibers through paper, and one hollow tube with a diameter of 3 mm is passed through the center of the cylinder. Support structures are provided in the tube, which divide the inside of the tube into 3 passages with identical cross-sectional area. The hollow tube is provided with a plurality of holes in the wall thereof. The total cross-sectional area of the hollow tube is 10% of the cross-sectional area of a controlled filtration unit.

The filtration and adsorption segment is a filter rod of cellulose acetate fiber for conventional cigarette.

When processing the cigarette, silica gel is preliminarily prepared into a hollow envelope of 45 mm in length, the filtration and adsorption segment made of cellulose acetate fiber is charged into the prepared envelope, with the cross section thereof being parallel with the bottom (sucking end near the consumer) of the envelope. With the space for the hollow segment remaining, the temperature control segment and the smoking article zone of tobacco thin sheet are successively charged, with one end of the smoking article zone being at the same level as the front end surface of the cigarette. The pre-prepared cleaning isolation sleeve is finally covered on the front end of the cigarette, with the lower edge wall of the cap comes into contact with the internal surface of the front end wall of the envelope. Finally, a piece of conventional cigarette tipping paper (aesthetic paper) having a thickness of 0.1 mm and a length equivalent to the length of the envelope is wrapped and bonded by glue around the envelope along the axial direction of the envelope.

EXAMPLE 6

A heat-not-burn cigarette is composed of a hollow envelope having a length of 46 mm and a diameter of 7.1 mm made of paper with a thickness of 0.2 mm, a cleaning isolation sleeve disposed around a front end of the envelope, and a smoking article zone and a cooling and filtration zone sequentially disposed in the envelope. The cleaning isolation sleeve is a cover-type gel cap that is pre-prepared into a bottle cap structure. The cap has a thickness of 0.15 mm, an inner diameter of 6.9 mm and a length of the lower edge of 6 mm. In a circular region with a diameter of 6.5 mm from the center of the cap, 20 air inlet holes with a diameter of 0.6 mm are provided. The smoking article zone is filled with cut tabacco arranged in random order, and has a length of 14 mm. The cooling and filtration zone is 32 mm in length and composed by a cylinder made of polylactic acid fiber only.

The cooling and filtration zone is a cylinder formed by wrapping multiple polylactic acid fibers through paper, and one hollow tube with a diameter of 3 mm is passed through the center of the cylinder. Support structures are provided at the center line of the tube, which divide the inside of the tube into 2 passages with identical cross-sectional area. The hollow tube is provided with a plurality of holes in the wall thereof. The total cross-sectional area of the hollow tube is 95% of the cross-sectional area of a controlled filtration unit.

When processing the cigarette, a piece of paper is preliminarily prepared into a hollow envelope of 46 mm in length, the cooling and filtration zone made of cellulose acetate fiber is charged into the prepared envelope, with the cross section thereof being parallel with the bottom (sucking end near the consumer) of the envelope. The smoking article zone of cut tobacco are successively charged, with one end of the smoking article zone being at the same level as the front end surface of the cigarette. The pre-prepared cleaning isolation sleeve is finally covered on the front end of the cigarette. Finally, a piece of conventional cigarette tipping paper (aesthetic paper) having a thickness of 0.15 mm and a length of 40 mm is wrapped and bonded by glue around the envelope along the axial direction of the envelope, with one end of the aesthetic paper being aligned with the rear end (sucking end near the consumer) of the envelope and the other end abutting with the lower edge of the cap.

EXAMPLE 7

A heat-not-burn cigarette is composed of a hollow envelope having a length of 46 mm and a diameter of 7.3 mm made of PET with a thickness of 0.2 mm, a cleaning isolation sleeve disposed around a front end of the envelope, and a smoking article zone and a cooling and filtration zone sequentially disposed in the envelope. The cleaning isolation sleeve is an embedded paper cap that is pre-prepared into a bottle cap structure. The cap has a thickness of 3 mm, an inner diameter of 6.6 mm and a length of the lower edge of 3 mm. In a circular region with a diameter of 6 mm from the center of the cap, 30 air inlet holes with a diameter of 0.3 mm are provided. The smoking article zone is filled with cut stem arranged in random order, and has a length of 13 mm. The cooling and filtration zone is 33 mm in length and composed of 2 portions, of which the portion close to the smoking article is a limit segment with a length of 5 mm, and a portion connected to the temperature control segment is a hollow segment with a length of 28 mm.

The limit segment is a cylinder formed of cellulose acetate fiber, and one aerosol passage opening having a fan-shaped cross section is formed therethrough, the cross-sectional area of the opening being 10% of the total cross-sectional area of the limit segment.

One row of annular air supplement holes are provided in the portion of the envelope surrounding the smoking article zone. The row of holes are in a distance of 3 mm from an isolation member, the row having 20 holes and each of the holes having a diameter of 0.2 mm. Another row of annular air supplement holes are provided in the portion of the envelope corresponding to the hollow segment. The another row of holes are in a distance of 5 mm from the end line of the smoking article, the row having 20 holes and each of the holes having a diameter of 0.2 mm. This structure is used to supplement the natural air from outside and reduce temperature of cigarette gas.

When processing the cigarette, PET plastic is preliminarily prepared into a hollow envelope of 45 mm in length. With the space for the hollow segment remaining, the limit segment and the smoking article zone of cut tobacco stem are successively charged, with one end of the smoking article zone being at the same level as the front end surface of the cigarette. The pre-prepared cleaning isolation sleeve is finally covered on the front end of the cigarette, with the lower edge wall of the cap comes into contact with the internal surface of the front end wall of the envelope. Finally, a piece of conventional cigarette tipping paper (aesthetic paper) having a thickness of 0.15 mm and a length equivalent to the length of the envelope is wrapped and bonded by glue around the envelope along the axial direction of the envelope.

In this example, the cleaning isolation cap prepared by pulp pressing, drying and forming is low in cost and easy to process. In addition, an amount of anti-coking agent can be added to the pulp, so that the paper cap does not generate scorch and release odor due to high temperature during the contact with the heating body. The paper material itself has low toughness, which is suitable for piercing heating body.

Meanwhile, due to the use of the smoking article in the form of cut stem, the temperature of the aerosol generated by heating is lower than that of the thin sheet smoking article. Since the holes formed in the envelope have an auxiliary cooling effect, the temperature control segment can be omitted in the rear section.

EXAMPLE 8

A heat-not-burn cigarette is composed of a hollow envelope having a length of 44 mm and a diameter of 7.1 mm and made of aluminum foil with a thickness of 0.08 mm, a cleaning isolation sleeve disposed around a front end of the envelope, and a smoking article zone and a cooling and filtration zone sequentially disposed in the envelope. The cleaning isolation sleeve is a cover-type silica gel cap that is pre-prepared into a bottle cap structure. The cap has a thickness of 0.015 mm, an inner diameter of 6.9 mm and a length of the lower edge of 5 mm. In a circular region with a diameter of 6 mm from the center of the cap, 22 air inlet holes with a diameter of 0.4 mm are provided. The smoking article zone is filled with filament smoking articles arranged in the same order along the axial direction of the envelope and made of wood pulp fiber sheet, and has a length of 12 mm. The cooling and filtration zone is 32 mm in length and composed of 2 portions, of which the portion close to the smoking article is a temperature control segment with a length of 20 mm and a portion connected to the temperature control segment is a filtration and adsorption segment with a length of 12 mm.

The temperature control segment is a cylinder formed by wrapping multiple polylactic acid fibers through paper, and 4 hollow tubes are passed through the center of the cylinder, in which the centered hollow tube has a tube diameter of 3 mm and the 3 hollow tubes outward are arranged in a triangle and have a diameter of 1.5 mm.

The filtration and adsorption segment is a paper rod (made of wood pulp fiber).

When processing the cigarette, a piece of aluminum foil is preliminarily prepared into a hollow envelope of 44 mm in length, the filtration and adsorption segment made of paper fiber is charged into the prepared envelope, with the cross section thereof being parallel with the bottom (sucking end near the consumer) of the envelope. The temperature control segment and the smoking article zone of wood pulp fiber sheet are successively charged, with one end of the smoking article zone being at the same level as the front end surface of the cigarette. The pre-prepared cleaning isolation sleeve is finally covered on the front end of the cigarette. Finally, a piece of conventional cigarette tipping paper (aesthetic paper) having a thickness of 0.05 mm and a length equivalent to the length of the envelope is wrapped and bonded by glue around the envelope along the axial direction of the envelope.

The multi-tube temperature control segment of the cigarette with such a structure can absorb the heat of the aerosol more effectively while ensuring the passage of the aerosol, thereby avoiding the problem that the polylactic acid fiber is deformed by heat to block the aerosol passage.

EXAMPLE 9

A heat-not-burn cigarette is composed of a hollow envelope having a length of 45 mm and a diameter of 7.1 mm made of aluminum foil/paper composite with a thickness of 0.15 mm, a cleaning isolation sleeve disposed around a front end of the envelope, and a smoking article zone and a cooling and filtration zone sequentially disposed in the envelope. The cleaning isolation sleeve is a pre-die-cut circular aluminum foil sheet of which the edge band is pressed into a shape with a plurality of grooves, like an aluminum beer bottle cap. The circular aluminum foil sheet has a thickness of 12 μm and an inner circle diameter of 7 mm. In a circular region with a diameter of 6.5 mm from the center of the aluminum foil, 25 air inlet holes with a diameter of 0.6 mm are provided. The smoking article zone is filled with tobacco sheet filament smoking articles arranged in the same order along the axial direction of the envelope, and has a length of 13 mm. The cooling and filtration zone is 32 mm in length and composed of, at the rear of the cigarette, four portions, of which the portion close to the smoking article is a limit segment with a length of 3 mm, a portion connected to the limit segment is a hollow segment with a length of 6 mm, a portion connected to the hollow segment is a temperature control segment with a length of 15 mm, and a portion connected to the temperature control segment is a filtration and adsorption segment with a length of 8 mm.

The limit segment is a cylinder formed of ceramic material, and 5 aerosol passage openings having a fusiform cross section are formed therethrough, the total cross-sectional area of the openings being 80% of the total cross-sectional area of the limit segment.

The temperature control segment is a cylindrical filter rod of cellulose acetate fiber, and polylactic acid particles in a circular shape having a particle size ranging from 20 to 60 mesh are uniformly add therein.

The filtration and adsorption segment is a cellulose acetate fiber rod for conventional cigarette.

When processing the cigarette, the aluminum foil/paper composite is preliminarily prepared into a hollow envelope of 45 mm in length, the filtration and adsorption segment is charged into the prepared envelope, with the cross section thereof being parallel with the bottom (sucking end near the consumer) of the envelope. After charging the temperature control segment, with the space for the hollow segment remaining, the smoking article zone of tobacco thin sheet are successively charged, with one end of the smoking article zone being at the same level as the front end surface of the cigarette. The pre-prepared cleaning isolation sleeve is finally covered on the front end of the cigarette, and the lower edge part of the cap with grooves is pressed and fitted closely on the outer wall of the envelope using a fastening tool. Finally, a piece of conventional cigarette tipping paper (aesthetic paper) having a thickness of 0.08 mm and a length equivalent to the length of the envelope is wrapped and bonded by glue around the envelope along the axial direction of the envelope.

With the use of the cleaning isolation cap made of aluminum foil and having the lower edge part with grooves, the joint part between the cap and the cigarette is aesthetic and smooth, which facilitates the forming.

EXAMPLE 10

A heat-not-burn cigarette is composed of a hollow envelope having a length of 45 mm and a diameter of 7.3 mm made of gel with a thickness of 0.1 mm, a cleaning isolation sheet pressed and affixed around a front end of the envelope, and a smoking article zone and a cooling and filtration zone sequentially disposed in the envelope. The cleaning isolation sheet is a pre-die-cut circular aluminum foil sheet having a diameter of 7.5 mm and a thickness of 7 μm. In a circular region with a diameter of 6.8 mm from the center of the aluminum foil, 35 air inlet holes with a diameter of 0.2 mm are provided. The smoking article zone is filled with expanded plant particles by microwave, and has a length of 13 mm. The cooling and filtration zone is 32 mm in length and composed of, at the rear of the cigarette, three portions, of which the portion close to the smoking article is a limit segment with a length of 6 mm, a portion connected to the limit segment is a temperature control segment with a length of 20 mm, and a portion connected to the temperature control segment is a filtration and adsorption segment with a length of 6 mm.

The limit segment is a rust-proof carbon steel spiral spring. The spring has an outer diameter of 5 mm and an inner diameter of 4 mm.

The temperature control segment is a cylindrical filter rod of cellulose acetate fiber, and polylactic acid powder with a particle size ranging from 800 to 1200 mesh are uniformly add therein.

The filtration and adsorption segment is a polylactic acid fiber rod.

When processing the cigarette, gel material is preliminarily prepared into a hollow envelope of 45 mm in length, the filtration and adsorption segment is charged into the prepared envelope, with the cross section thereof being parallel with the bottom (sucking end near the consumer) of the envelope. The temperature control segment, the limit segment, and the smoking article zone of expanded plant particles by microwave are successively charged, with one end of the smoking article zone being at the same level as the front end surface of the cigarette. The pre-prepared cleaning isolation sheet is finally affixed by heat bonding on the front end of the cigarette, and the part that is out of the diameter of the envelope is bonded by pressing using a heating die on the outer wall of the envelope at the front end thereof. Finally, a piece of conventional cigarette tipping paper (aesthetic paper) having a thickness of 0.03 mm and a length equivalent to the length of the envelope is wrapped and bonded by glue around the envelope along the axial direction of the envelope.

When the limit segment of the spring type is used, the thermal energy of absorbed cigarette gas can be adjusted by adjusting the density of the spiral ring of the limiting spring. Also, the spring has a limit function. Since the limiting spring has elasticity, it can absorb the pressure toward the rear of the cigarette generated when the heating body is inserted into the smoking articles, and does thus not cause the smoking articles to be squeezed together and deformed to cause poor contact with the heating body or partially block the cigarette gas passage. When the heating body is inserted until its position, the resilience force of the spring thereof causes the smoking articles (especially the shredded tobacco) displaced to the rear to be pushed back to the original position, thereby maintaining good contact with the heating body.

EXAMPLE 11

A heat-not-burn cigarette is composed of a hollow envelope having a length of 45 mm and a diameter of 7.3 mm made of polylactic acid with a thickness of 0.08 mm, a cleaning isolation sleeve disposed around a front end of the envelope, and a smoking article zone and a cooling and filtration zone sequentially disposed in the envelope. The cleaning isolation sleeve is a pre-prepared embedded cap that is formed by pressing tobacco leaf powder or microwave-expanded tobacco stem powder and has a thickness of 0.1 mm, an inner diameter of 6.8 mm and a length of the lower edge of 3 mm. In a circular region with a diameter of 6 mm from the center of the cap, 20 air inlet holes with a diameter of 0.5 mm are provided. The smoking article zone is filled with filament smoking articles that is arranged in the same order along the axial direction of the cigarette and made from jute pulp fiber thin sheet, and has a length of 13 mm. The cooling and filtration zone is 32 mm in length and composed of two portions, of which the portion close to the smoking article is a limit segment with a length of 10 mm, and a portion connected to the limit segment is a filtration and adsorption segment with a length of 22 mm.

The limit segment is a spiral spring made of plastic with good elasticity. The spring has an outer diameter of 4 mm and an inner diameter of 3 mm.

The filtration and adsorption segment is a polylactic acid fiber rod.

The method for processing the cigarette is the same as Example 7. When the consumer uses the cigarette of such a structure, the length of the heating body of the heater used should not exceed 13 mm.

When a limit spring made of plastic material is used, the cost is low and it does not rust due to moisture.

EXAMPLE 12

A heat-not-burn cigarette is composed of a hollow envelope having a length of 46 mm and a diameter of 7.1 mm made of paper with a thickness of 0.2 mm, a cleaning isolation sheet affixed and pressed around a front end of the envelope, and a smoking article zone and a cooling and filtration zone sequentially disposed in the envelope. The cleaning isolation sheet is a PP plastic thin sheet that is preliminarily die-cut into a circular shape and has a diameter of 7.1 mm and a thickness of 25 μm. In a circular region with a diameter of 6.8 mm from the center of the thin sheet, 18 air inlet holes with a diameter of 0.6 mm are provided. The smoking article zone is filled with cut tobacco stem, and has a length of 15 mm. The cooling and filtration zone is 31 mm in length and composed of, at the rear section of the cigarette, two portions, of which the portion close to the smoking article is a limit segment with a length of 20 mm, and a portion connected to the limit segment is a filtration and adsorption segment with a length of 11 mm.

The limit segment is a plastic spiral spring having an outer diameter of 5 mm and an inner diameter of 4 mm. A layer of polylactic acid fiber is wrapped around the plastic spring wire.

The filtration and adsorption segment is a cylindrical filter rod of polylactic acid fiber.

The method for processing the cigarette is the same as Example 10 with exception that the cleaning isolation sheet is glued to the front end surface of the cigarette.

When the limit spring wrapped with polylactic acid fiber is used, the limit spring can have both a limit function and a function of temperature control. Therefore, the limit segment and the temperature control segment in the example are integrally formed. With such a design, the structure of the cigarette is further simplified and the cost is lowered on the premise of ensuring the quality.

EXAMPLE 13

The last example is repeated with exception of the following differences:

The cooling and filtration zone is composed of four units in combination that are sequentially arranged in the order of a limit segment, a hollow segment, a polylactic acid fiber temperature control segment with two hollow tubes (a plurality of holes are formed in the tube), and a filtration and adsorption segment of cellulose acetate fiber. With such a configuration, when passing through the aerosol passage holes in the limit segment to reach the sucking end, the aerosol preferentially comes into contact with the polylactic acid fiber adsorption segment. Since the polylactic acid fiber has a function of absorbing heat to cause deformation, it absorbs a large amount of heat from the adsorbed aerosol to lower the temperature of aerosol. The resulting deformation causes the polylactic acid fiber on the end face of the limit segment that is contacted to contract and solidify, thereby blocking part of the aerosol passage. Here, the intermediate tube does not deform and can instead function as a passage. Meanwhile, the heat in the subsequent aerosol can be transmitted through the plurality of openings in the passage to the polylactic acid fiber at the corresponding position, thereby finally achieving the dual effect of effectively reducing the temperature of the aerosol without blocking the aerosol passage. The hollow segment is disposed between the limit segment and the temperature control segment, and when deformation of fiber, due to heat absorption, on the side wall of the temperature control segment causes the aerosol passage to be partially blocked, the hollow segment can serve to guide the aerosol toward the tube port at the center of the temperature control segment.

EXAMPLE 14

Example 11 is repeated with exception of the following differences:

The limiting segment is a spiral limiting spring made of plastic, and the limiting spring has an outer diameter of 3 mm and an inner diameter of 2.5 mm in a cross section thereof.

The temperature control segment is made of a cellulose acetate fiber filter rod to which polylactic acid particles are added, and the polylactic acid particles are irregular and have a particle diameter ranging from 100 to 200 mesh.

What is claimed is:

1. A heat-not-burn cigarette comprising:

an envelope that is cylindrical and hollow, a cleaning isolation sleeve disposed at a front end of the envelope, and a smoking article zone and a cooling and filtration zone sequentially disposed in the envelope, wherein the cleaning isolation sleeve is provided with a plurality of air inlet holes in a region thereof covering a cross section of the envelope, and has a thickness of 3 μm to 3 mm;

the smoking article zone is, at one end thereof, intimately connected to the cleaning isolation sleeve and, at the other end thereof, connected to the cooling and filtration zone;

the cooling and filtration zone is formed by one of a limit segment, a temperature control segment, a hollow segment and a filtration and adsorption segment, or a combination thereof; and the smoking article segment and the cooling and filtration segment have a diameter equivalent to an inner diameter of the envelope.

2. The heat-not-burn cigarette according to claim 1, wherein the cleaning isolation sleeve is made of a flexible sheet material, the cleaning isolation sleeve surrounds and covers the front end of the envelope, and a portion out of the part covering the cross section of the envelope is folded and pressed to intimately bond to and integrally form with an outer wall of the envelope.

3. The heat-not-burn cigarette according to claim 1, wherein the cleaning isolation sleeve is in a shape of a disk and has a diameter equivalent to an outer diameter of the envelope, and the cleaning isolation sleeve covers an end of the envelope and an end the smoking article zone by gluing.

4. The heat-not-burn cigarette according to claim 1, wherein the cleaning isolation sleeve has a circular bottle cap structure that is provided around the front end of the envelope, and a fastening edge portion of the cleaning isolation sleeve is around the outer wall of the envelope at the front end thereof, or inserted into the inner wall of the envelope at the front end thereof.

5. The heat-not-burn cigarette according to claim 1, wherein the materials for both the envelope and the cleaning isolation sleeve are one of aluminum foil, aluminum foil/paper composite, plastic, silica gel, gel, paper material, metal, wood and polylactic acids.

6. The heat-not-burn cigarette according to claim 2, wherein the envelope is further wrapped at the outer side thereof with an aesthetic paper in an axial direction of the envelope, the aesthetic paper having a length equivalent to that of the envelope.

7. The heat-not-burn cigarette according to claim 5, wherein the smoking article zone includes one or more of elongated strip-shaped smoking articles which are preliminarily formed in a cylindrical shape by paper rolls and arranged in order along the axial direction of the envelope, curved filament smoking articles which are preliminarily formed in a cylindrical shape by paper rolls and arranged in random order, and irregular granule smoking articles.

8. The heat-not-burn cigarette according to claim 1, wherein the limit segment is a cylindrical body produced and molded by one or a combination of ceramic, wood, silica gel, plastic, polylactic acids, cellulose acetate fiber, plant powder, metal or other moldable high temperature resistant materials, and the limit segment is provided with at least one through-type aerosol passage opening, the aerosol passage opening being in one of a circular shape, an elliptical shape, a fusiform shape, a fan shape, a triangular shape, and shapes with 4-24 sides, and having a cross-sectional area that is 10-95% of the cross-sectional area of the limit segment.

9. The heat-not-burn cigarette according to claim 1, wherein the temperature control segment is a cylindrical body formed by wrapping multiple polylactic acid fibers or fibers having an endothermic effect with a paper material along the axial direction of the envelope; at least one hollow tube is further provided through the cylindrical body; the hollow tube has a plurality of holes formed in the tube wall, and has a total cross-sectional area that is 10-95% of a cross-sectional area of the filtration and adsorption segment; and the filtration and adsorption segment is a cylindrical body formed by wrapping at least one of multiple polylactic acid fibers, cellulose acetate fibers, and wood pulp fibers with a paper material.

10. The heat-not-burn cigarette according to claim 1, wherein the limit segment is a spiral limiting spring and is not adjacent to the hollow segment, and the limiting spring has a diameter smaller than and equal to the inner diameter of the envelope.

11. The heat-not-burn cigarette according to claim 1, wherein the temperature control segment is a cylindrical filter rod of cellulose acetate fiber or a paper filter rod of wood pulp fiber, and polylactic acid powder or particles with a particle size ranging from 20 to 1200 mesh are homogeneously added to the cellulose acetate fiber or wood pulp fiber of the filter rod.

12. The heat-not-burn cigarette according to claim 1, wherein the temperature control segment is a spiral temperature control spring wrapped with polylactic acid fiber, and the temperature control spring has a diameter smaller than and equal to the inner diameter of the envelope.

13. The heat-not-burn cigarette according to claim 7, wherein the irregular granule smoking article is produced by adding a smoking agent and a flavoring agent to plant granules and/or starch granules.

* * * * *